US005454484A

United States Patent [19]

Chelossi

[11] Patent Number: 5,454,484

[45] Date of Patent: Oct. 3, 1995

[54] PAPER CUP INSULATION

[75] Inventor: Jim Chelossi, San Carlos, Calif.

[73] Assignee: Sleevco, San Carlos, Calif.

[21] Appl. No.: 245,959

[22] Filed: May 19, 1994

Related U.S. Application Data

[63] Continuation-in-part of Ser. No. 952,204, Sep. 28, 1992, abandoned, which is a continuation of Ser. No. 843,541, Feb. 28, 1992, abandoned.

[51] Int. Cl.[6] ..... B65D 6/18

[52] U.S. Cl. ..... 220/738; 229/4.5

[58] Field of Search ..... 229/1.5 H, 1.5 B, 229/4.5; 206/217; 220/737, 738, 739

[56] References Cited

U.S. PATENT DOCUMENTS

| | | | |
|---|---|---|---|
| 1,866,805 | 7/1932 | Haywood | 229/1.5 H |
| 1,950,505 | 3/1934 | Matters | 229/1.5 H |
| 2,244,940 | 6/1941 | Carruth | 229/117.01 X |
| 4,720,037 | 1/1988 | Alpert | 229/1.5 H |
| 5,205,473 | 4/1993 | Coffin, Sr. | 229/1.5 H X |
| 5,238,161 | 8/1993 | Kimishima | 229/1.5 H X |

*Primary Examiner*—Allan N. Shoap
*Assistant Examiner*—Christopher J. McDonald

[57] ABSTRACT

A paper sleeve of with graduadly changing shape, stored in folded configuration, easy to expand for receiving a cup with at least a section being conical and containing hot beverage provides thermal protection to the hand carrying the cup.

11 Claims, 2 Drawing Sheets

PAPER CUP INSULATION

This a Continuation-in-Part application of my patent application Ser. No. 07/952,204, filed Sep. 28, 1992, now abandoned which is a continuation application of may application Ser. No. 07/843,541, filed on Feb. 28, 1992, now abandoned.

BACKGROUND OF THE INVENTION

This invention relates to means for protecting the user of a plastic or paper cup from the heat of hot beverage contained in the cup. More specifically this invention relates to a sleeve to be slipped over a conic plastic or paper cup providing sufficient thermal insulation to protect the user.

There are number of attachments known providing a handle for cups of different sizes. These attachments enclose the cup and have tabs extending away from the cup. These tabs can be used as handles but they are not a safe way for carrying the cup due to the lack of sturdiness. Other attachments use material such as corrugated paper or plastic material to protect the user's hand from the heat radiated by the contents of the cup. These insulating sleeves are not foldable or collapsible for efficient storage.

OBJECTS OF THE INVENTION

It is an object of this invention to provide a simple and inexpensive thermal insulation for safe manipulation of a plastic or paper cup containing a hot beverage.

It is another object of this invention to provide a thermal insulation means which requires little storage space prior to use in combination with a plastic or paper cup.

It is still another object of this invention to provide a thermal insulation means which is stored in a folded configuration with little space requirement and which can easily be expanded for use in combination with a plastic of paper cup.

SUMMARY OF THE INVENTION

The present invention overcomes the above mentioned deficiencies and provides for an easy to store, disposable low-cost insulating sleeve to be placed around a cup containing a hot beverage. The sleeve of the present invention is folded in a flat configuration, using little space. Its structure allows easy unfolding and quick attachment to a cup thereby reducing the time to make use of the insulating sleeve and reducing the possibility that the contents of the cup could be spilled while the sleeve is attached to a filled cup. Providing sufficient thermal insulation eliminates the need for a tab.

SHORT DESCRIPTION OF THE FIGURES

FIG. 1*a* is an illustration of the paper stock stripe from which the beverage cup sleeve is made.

FIG. 1*b* is an illustration of a folded beverage cup sleeve.

DESCRIPTION OF THE PREFERRED EMBODIMENT

Figure 1B:
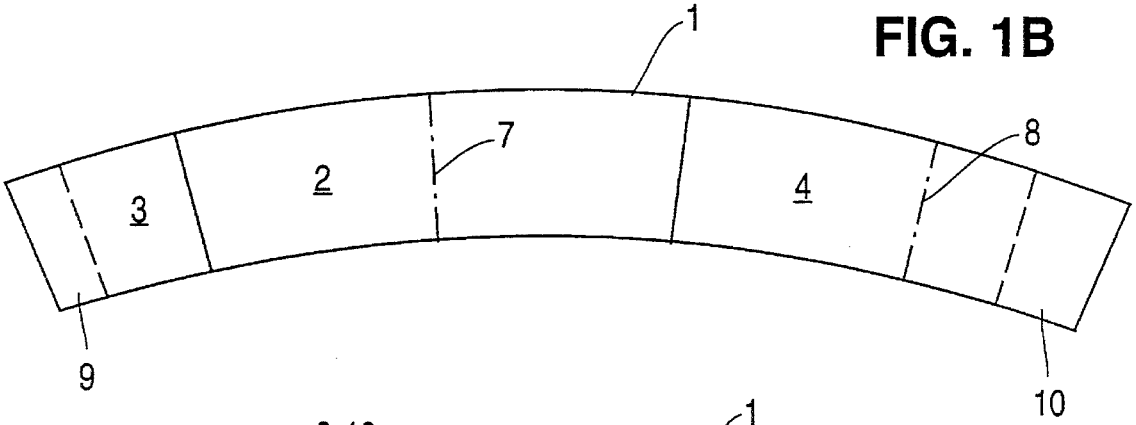
Figure 1A:
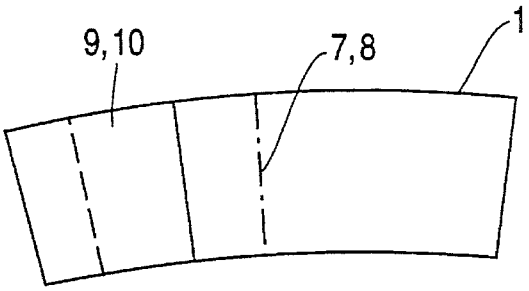
Figure 3:
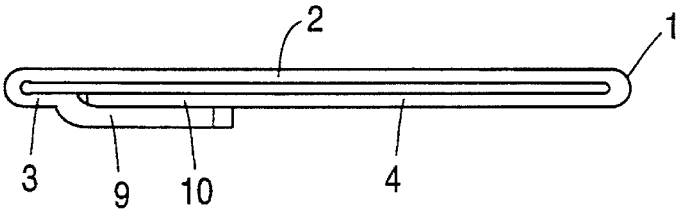
FIG. 3 is an illustration of a beverage cup with an insulating sleeve.
Figure 3:
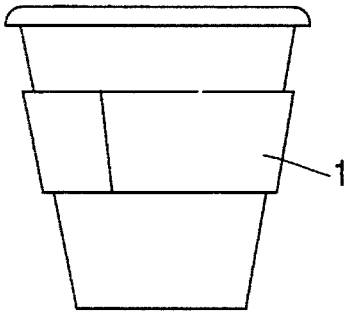

FIG. 1*a* is an illustration of the paper stock band or stripe from which the insulating sleeve is made by folding, and gluing or otherwise connecting the ends of the stripe with each other.

Stripe 1 may be scored at the locations of the intended folds 5 and 6 which separate center section 2 from the two end sections 3 and 4. To achieve a tapered form folds 5 and 6 are angled to each other. The angle depends on the shape of the conical sectopn of the hot beverage cup. Thus, the insulation sleeve forms a fustrum of a body with tapered cross-sections. Depending upon the expansion by implying an inwardly directed squeezing force on the folds the sleeve will assume a cross-sectional shape of an eye or leaf with an opening sufficient to receive the hot beverage cup. If two additional scores are made half way between the folds, then the sleeve will expand with cross-sections in the shape of bulging squares.

FIG. 1*b* is an illustration of the folded insulating sleeve of the present invention.

Figure 2:
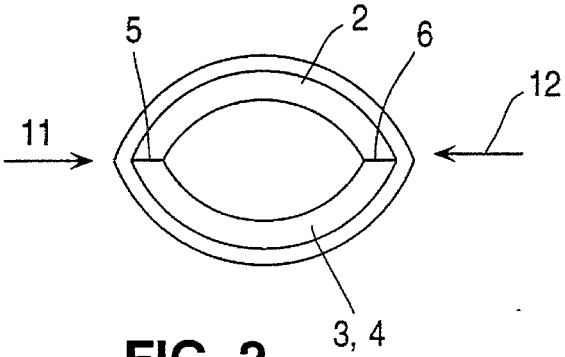
FIG. 2 is an illustration of an opened beverage cup sleeve.
Figure 4:
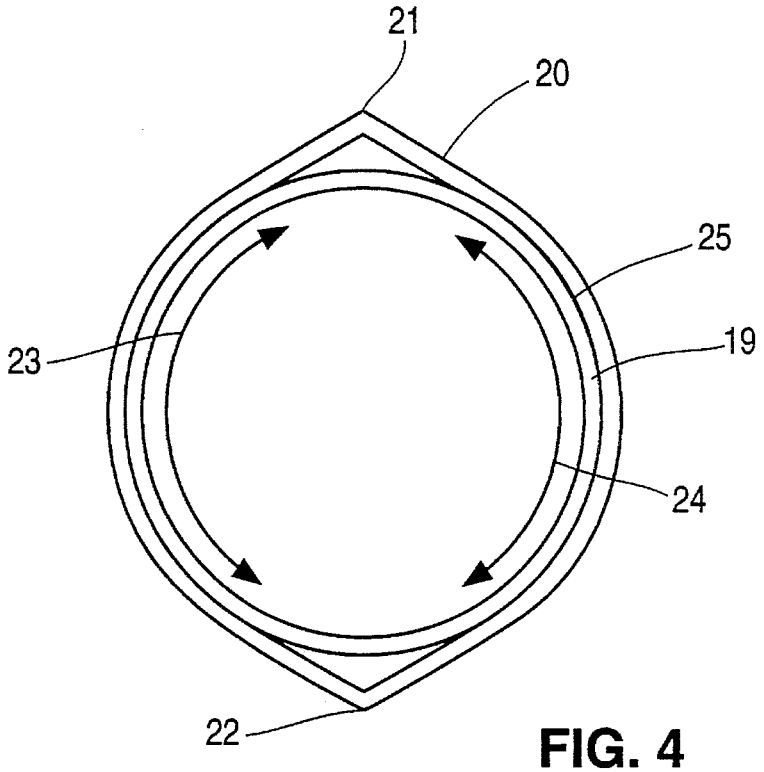
FIG. 4 is a first cross-sectional illustration of a beverage cup with an insulating sleeve.

The insulating sleeve consists of a paper stripe 1 of sufficiently strong card stock. Stripe 1 is folded to provide a center section 2 and two end sections 3 and 4. Center section 2 and end sections 3 and 4 are separated by folds 5, respectively 6. End sections 3 and 4 may be of equal length. However, in FIGS. 1*a* and 1*b* end sections 3 and 4 are of different length. End sections 3 and 4 have overlapping areas 9 and 10, which are adhesively or otherwise bonded with each other to form a conical sleeve when expanded. The folded sleeve expands to a sleeve with eye-shaped cross-sections by squeezing the folded sleeve at folds 5 and 6 in directions indicated by arrows 11 and 12, see FIG. 2. A sufficient squeeze will open the sleeve to an oval or eye like shape, providing an opening to receive the bottom end of a conical beverage cup. It is the ease with which the sleeve opens in response to squeezing it at folds 5 and 6 which makes the invention easy to use. The stiffness of the selected card board determines the force with which the sleeve will hold the beverage cup even before the sleeve is fully expanded and in full compliance with the shape of the beverage cup. Once a conical cup of appropriate shape and size is placed inside the sleeve, the sleeve can be advanced until it safely holds the cup. However, the sleeve may safely hold the beverage cup by its clamping force. FIG. 4 is a cross-sectional illustration in which the beverage cub is not fully forced into the sleeve, but the clamping force of the sleeve will safely hold the beverage cup.

Figure 5:
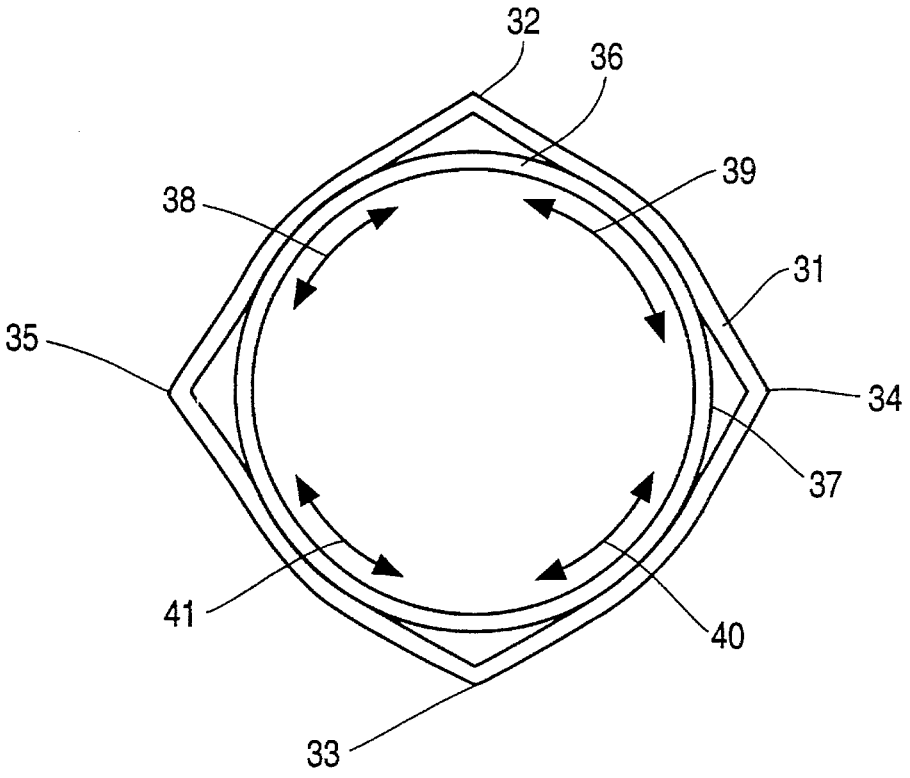
FIG. 5 is a second cross-sectional illustration of a beverage cup with an insulating sleeve.

In a different embodiment center section 2 and the longer one of the end sections 3 and 4 include opposing scores 7 and 8. Scores 7 and 8 cause the stripe between folds S and 6 to open up in a more square than oval configuration as soon as a squeeze is applied to folds S and 6. FIG. 5 is a cross-sectional illustration of a beverage cup not fully forced into the sleeve but held by the clamping force of the sleeve with two folds and two scores.

The stiffness of the card stock keeps the sleeve in folded shape until it is selected for use. Applying a squeezing force on the two folds opens the sleeve. As soon as the width at the upper end of the opened sleeve is larger than the diameter at the bottom of the cup, the cup can be inserted into the sleeve. Releasing the squeezing force clamps the cup in the sleeve, without the sleeve being fully expanded to a circular cross-section needed for complete compliance with the shape of the beverage cup.

FIGS. 4 and 5 are illustrations of the cross-sections of the combination of cup and sleeve. In FIG. 4, sleeve 20 has two folds 21 and 22 and no additional scores. Unless cup 19 is forced fully into sleeve 20, sleeve 20 contacts only two areas 23 and 24 of the outer surface 25 of cup 19. In FIG. 5, sleeve 31 has two folds 32 and 33, and two scores 34 and 35. Unless cup 36 is forced fully into sleeve 31, sleeve 31 contacts only four areas 38, 39, 40 and 41 of the outer surface 37 of cup 36.

Depending upon the difference in gradation of conical cup 19, respectively 36 and sleeve 20 respectively 31 in expanded form, the areas of contact will extend over the full width or only a part of sleeve 20, respectively 31.

Using such an insulating sleeve of the present invention permits the use of low-cost generic cups, while the sleeve can be illustrated with any desired logo, design or other types of information.

The sleeve shown in the FIGURES is made from an arch shaped stripe 1 having equal width. Other shapes may be used to achieve different upper and lower borders of the sleeve and to make more efficient use of the paper stock without departing from the spirit of the present invention.

What I claim is:

1. An insulating holder for a hot beverage cup having a conical section, said holder providing thermal protection to the hand of a user holding said cup, said holder consisting essentially of a sleeve including a stripe of strong thermally insulating card stock having two folds, said folds being angled to each other and dividing said stripe into a left end section, a center section, and a right end section;

said center section having a length of half the circumference of said beverage cup;

said left and right end sections providing an inside and an outside surface when said left end section and said right end section are folded inwardly over said center section;

said left and right end sections having a total length exceeding the length of said center section for providing overlapping bonding areas for bonding the inside of said bonding area of one of said end sections to the underlying outside of said bonding area of the other one of said end sections;

said so bonded left and right end sections providing a half section equal in length to said center section, said center section and said half section forming said sleeve;

said folds adapting said sleeve for storage in a flat folded configuration and for receiving said beverage cup in an open configuration;

said card board having a stiffness providing a clamping force onto said received beverage cup;

said shape of said insulating holder partially conforming with said conical section of said hot beverage cup.

2. An insulating holder as claimed in claim 1, wherein, when squeezed by an inwardly directed force on the folds, said sleeve opens to an eye or leaf shaped cross-sectional configuration for receiving said beverage cup and provides two limited direct contact areas between said sleeve and said beverage cup, thereby providing increased thermal insulation in areas of no contact between said sleeve and said beverage cub.

3. An insulating holder as claimed in claim 1, wherein said center section and said half section each include one score, said scores being located at the center of said center section and said half section, dividing the angle between said folds, opposing each other and allowing said sleeve to open to a bulging square shaped configuration for receiving said beverage cup.

4. An insulating holder as claimed in claim 3, wherein, when squeezed by an inwardly directed force on the folds, said sleeve opens to an outside bowed cross-sectional configuration for receiving said beverage cup and provides four limited direct contact areas between said sleeve and said beverage cup, thereby providing increased thermal insulation in areas of no contact between said sleeve and said beverage cup.

5. An insulating holder as claimed in claim 1, wherein said sleeve expands to an tapered leaf-shaped body when squeezed by an inwardly directed force applied to the folds, and wherein said sleeve provides a clamping force on said beverage cup normal to said inwardly directed force.

6. An insulating sleeve as claimed in claim 4, wherein, when squeezed by an inwardly directed force on the folds, said

7. The combination of a hot beverage cup and an insulating holder for said cup, said holder providing thermal protection to the hand of a user holding said cup, said holder consisting essentially of said cup having a conical section with the wider end located towards the top of said cup, a sleeve including a stripe of strong thermally insulating card stock having two folds, said folds being angled to each other and dividing said stripe-into a left end section, a center section, and a right end section;

said center section having a length of half the circumference of said beverage cup;

said left and right end sections providing an inside and an outside surface when said left end section and said right end section are folded inwardly over said center section;

said left and right end sections having a total length exceeding the length of said center section for providing overlapping bonding areas for bonding the inside of said bonding area of one of said end sections to the underlying outside of said bonding area of the other one of said end sections;

said so bonded left and right end sections providing a half section equal in length to said center section, said center section and said half section forming said sleeve;

said folds adapting said sleeve for storage in a flat folded configuration and for receiving said beverage cup in an open configuration;

said card board having a stiffness providing a clamping force onto said received beverage cup;

said shape of said insulating holder substantially conforming with a part of said conical section of said hot beverage cup.

8. The combination of a holt beverage cup and an insulating holder as claimed in claim 7", wherein, when squeezed by an inwardly directed force on the folds, said sleeve opens to an eye or leaf shaped cross-sectional configuration for receiving said beverage cup and provides two limited direct contact areas between said sleeve and said beverage cup, thereby providing increased thermal insulation in areas of no contact between said sleeve and said beverage cub.

9. The combination of a hot beverage cup and an insulating holder as claimed in claim 7, wherein said center section and said half section each include one score, said scores being located at the center of said center section and said half section, dividing the angle between said folds, opposing each other and allowing said sleeve to open to a bulging square shaped configuration for receiving said beverage cup.

10. The combination of a hot beverage cup-and an insulating holder as claimed in claim 9, wherein, when squeezed by an inwardly directed force on the folds, said sleeve opens to an outside bowed cross-sectional configuration for receiving said beverage cup and provides four limited direct contact areas between said sleeve and said beverage cup, thereby providing increased thermal insulation in areas of no contact between said-sleeve and said beverage cup.

11. The combination of a hot beverage cup and an insulating holder as claimed in claim 7, wherein said holder includes space for displaying information.

* * * * *